US005531939A

United States Patent [19]

Haley et al.

[11] Patent Number: 5,531,939

[45] Date of Patent: Jul. 2, 1996

[54] CONCENTRATED GLASS AND WINDOW CLEANING COMPOSITION AND METHOD OF USE

[75] Inventors: Kalliopi S. Haley, Byron Center; Jeffrey J. Fisher, Grand Rapids, both of Mich.

[73] Assignee: Amway Corporation, Ada, Mich.

[21] Appl. No.: 216,678

[22] Filed: Mar. 23, 1994

[51] Int. Cl.[6] ..... C11D 3/20

[52] U.S. Cl. ..... 510/182; 510/432; 510/494; 510/495

[58] Field of Search ..... 252/545, 548, 252/550, 554, 170, 174.17, DIG. 10

[56] References Cited

U.S. PATENT DOCUMENTS

| | | | |
|---|---|---|---|
| 4,077,917 | 4/1978 | Panzer | 252/545 |
| 4,556,509 | 12/1985 | Demangeon et al. | 252/545 |
| 4,673,523 | 6/1987 | Smith et al. | 252/91 |
| 5,254,290 | 10/1993 | Blandiaux et al. | 252/545 |
| 5,290,471 | 3/1994 | Greene et al. | 252/708 |

FOREIGN PATENT DOCUMENTS

| | | |
|---|---|---|
| 550465 | 6/1979 | Australia . |
| 528990 | 6/1979 | Australia . |
| 525798 | 6/1979 | Australia . |
| 525732 | 11/1979 | Australia . |
| 523665 | 1/1980 | Australia . |
| 622932 | 4/1990 | Australia . |
| 654320 | 8/1992 | Australia . |
| 0071410 | 2/1983 | European Pat. Off. . |
| 0071411 | 2/1983 | European Pat. Off. . |
| 130818 | 1/1985 | European Pat. Off. . |
| 071412 | 5/1985 | European Pat. Off. . |
| 140710 | 8/1985 | European Pat. Off. . |
| 261874 | 3/1988 | European Pat. Off. . |
| 328184 | 5/1989 | European Pat. Off. . |
| 0344847 | 6/1989 | European Pat. Off. . |
| 347110 | 12/1989 | European Pat. Off. . |
| 365170 | 4/1990 | European Pat. Off. . |
| 365184 | 4/1990 | European Pat. Off. . |
| 402981 | 12/1990 | European Pat. Off. . |
| 418986 | 3/1991 | European Pat. Off. . |
| 426876 | 5/1991 | European Pat. Off. . |
| 510565 | 10/1992 | European Pat. Off. . |
| 509608 | 10/1992 | European Pat. Off. . |
| 426943 | 5/1993 | European Pat. Off. . |
| 2153449 | 9/1971 | France . |
| 2153448 | 5/1973 | France . |
| 2380340 | 2/1977 | France . |
| 2556364 | 12/1983 | France . |
| 2585720 | 8/1985 | France . |
| 3-59958 | 2/1983 | Japan . |
| 1342360 | 1/1974 | United Kingdom . |
| 1378934 | 12/1974 | United Kingdom . |
| 1386875 | 3/1975 | United Kingdom . |
| 1398422 | 6/1975 | United Kingdom . |
| 2013235 | 2/1982 | United Kingdom . |
| 2021141 | 6/1982 | United Kingdom . |
| 2022126 | 10/1982 | United Kingdom . |
| 2204318 | 11/1988 | United Kingdom . |
| 2247243 | 2/1992 | United Kingdom . |
| WO91/15565 | 10/1991 | WIPO . |
| WO93/11213 | 6/1993 | WIPO . |
| WO93/14181 | 7/1993 | WIPO . |
| 9325654 | 12/1993 | WIPO . |
| WO93/25654 | 12/1993 | WIPO . |

*Primary Examiner*—Paul Lieberman
*Assistant Examiner*—Necholus Ogden

[57] ABSTRACT

Concentrated liquid glass and window cleaning compositions are disclosed containing high levels of solvents and exhibiting improved cleaning performance and homogeneity in solution. A preferred formulation includes sodium methyl oleoyl taurate, dioctyl sodium sulfosuccinate, a glycol ether solvent mixture and water and other optional ingredients to provide a concentrated cleaning composition which can be diluted by the end user to desired strength. Another preferred embodiment discloses a method of using a concentrated liquid glass and window cleaning composition.

14 Claims, No Drawings

CONCENTRATED GLASS AND WINDOW CLEANING COMPOSITION AND METHOD OF USE

BACKGROUND OF THE INVENTION

The present invention is directed to a concentrated glass and window liquid cleaning composition, more particularly to a concentrated glass and window liquid cleaning composition which has high solvent levels and low surfactant levels yet shows homogeneity in solution and excellent cleaning ability. A method for using such composition is also disclosed.

The compositions of the present invention and the methods of use relate to the specialized class of concentrated cleaning products which are designed to be used as is or diluted by the end user to a preferred strength for the particular job at hand. Such concentrated cleaning compositions can be applied from any type of hand-operated sprayer or from a bucket dilution, and more particularly can be applied from a hand-held sprayer such as is found in U.S. Pat. No. 5,152,461 and patent application Ser. No. 07/865,001, both of which are hereby incorporated by reference.

There has long been a desire to produce concentrated cleaners for consumer use. Concentrated cleaners provide high strength cleaning for difficult soils, economical solutions when diluted and minimize packaging and transportation costs. In some cleaning applications, such as heavy duty laundry applications, concentrated formulas based on high surfactant levels are known in the art and have been prepared successfully with the use of suitable surfactants and hydrotropes. Likewise, powder formulations with high concentrations are known in the art and are typically made through the use of agglomeration or similar technology.

Similarly, glass and window cleaners are known in the art such as that found in U.S. Pat. No. 4,863,629 which discloses glass and window cleaners having from 1% to 20% of a surfactant and from 1% to 20% of propylene glycol tert butyl ether. However, highly concentrated glass and window cleaners with low levels of surfactants and high levels of solvents which show homogeneity in solution and can be diluted by the end user to a preferred strength are not known in the art. This is due in part to the need in a consumer product of several characteristics such as dilutability, limited streaking, quick evaporation, good cleaning characteristics, stability and the ability to meet safety standards for household use.

Problems often occur when attempting to produce a glass and window cleaner in highly concentrated form such as the composition of the present invention. Solvents which evaporate quickly typically have low flash points and on increasing the concentration of these solvents, compositions with unacceptably low formula flash points are produced. Also, typically, solvents which exhibit high soil solvency tend to have lower evaporation rates, which results in products which are difficult for the consumer to use. Therefore, above certain solvent concentrations, it has been difficult to formulate a concentrated product which meets consumer acceptability. Further, streaking is often an inherent problem in glass and window cleaning compositions. Therefore, the use of builder salts or high levels of surfactants in order to increase the concentrations of the product or the cleaning ability of the products is discouraged as builder salts and surfactants can create or increase streaking.

One approach known in the art has been the use of solvent blends, combining higher and lower volatility solvents, to enhance evaporation and raise flash points. Solvent blends with both high evaporation rates and high flash points typically exhibit instabilities in product formulations containing surfactants and water. Further, high solvent glass and window cleaning systems typically suffer from problems of lack of homogeneity, thus requiring the consumer to extensively agitate the product prior to using in order to obtain an equal dispersion of materials.

SUMMARY OF THE INVENTION

In a first embodiment, the present invention discloses a highly concentrated glass and window cleaning composition comprising:

(1) from about 0.1% to about 20% of at least one anionic surfactant such as the sulfosuccinates derived from mono or diesters of maleic acid and the taurates derived as condensation products of $C_8$–$C_{20}$ fatty acids and taurines;

(2) from about 10% to about 75% of a mixture of at least two glycol ether solvents selected from ethylene glycol monoalkyl ethers and propylene glycol monoalkyl ethers; and (3) water and optional ingredients comprising the balance.

In a second embodiment, a method of using a highly concentrated glass and window cleaning composition is disclosed comprising the steps of diluting the glass and window cleaning composition to the end user's preferred strength, applying the glass and window cleaning composition to the area to be cleaned and wiping from the area the glass and window cleaning composition.

In the compositions of the present invention, it has been surprisingly found that a highly concentrated cleaning system which exhibits dilutability, homogeneity in solution, excellent cleaning performance, fast evaporation, limited streaking and acceptable flash points can be prepared by combining substantially low percentages of at least one wetting agent such as an anionic surfactant and a high level of a glycol ether solvent mixture. The composition of the present invention also allows the end user to dilute the composition to a preferred strength from a hand-held sprayer or in a bucket application. It is noted that while the compositions of the present invention can be used in a variety of cleaning applications, the compositions of the present invention are most often used as glass and window spray and wipe household cleaning products.

In the description that follows, it is to be assumed that all percentages are based on the total weight of the composition.

DETAILED DESCRIPTION OF THE PREFERRED EMBODIMENT

In the first preferred embodiment, the concentrated glass and window cleaning composition is disclosed comprising at least one anionic surfactant and a glycol ether solvent mixture with water and optional ingredients comprising the balance.

In the second preferred embodiment, a method for cleaning glass, windows, hard surfaces and the like with a concentrated glass and window spray and wipe cleaning composition is disclosed comprising the steps of diluting the concentrated glass and window cleaning composition with water in a strength acceptable to the end user, applying the glass and window cleaning composition to the surface to be cleaned and wiping the glass and window cleaning composition from the surface. The principle ingredients are included in the highly concentrated glass and window cleaning compositions of the present invention in the following percentage ranges:

| Ingredient | Preferred Range | More Preferred Range | Most Preferred Range |
|---|---|---|---|
| Anionic Surfactants | from about 0.1% to about 20% | from about 2% to about 10% | from about 2% to about 4% |
| Glycol Ether Solvent Mixture | from about 10% to about 75% | from about 30% to about 65% | from about 45% to about 55% |
| Water and Other Optional Ingredients | balance | balance | balance |

Anionic Surfactants

Anionic surfactants can be broadly described as water-soluble salts of organic reaction products having in their molecular structure an anionic solubilizing group such as the carboxylates, sulfates, sulfonates and phosphates, an alkyl radical containing from about 8 to about 22 carbon atoms and a cationic moiety selected from the alkali metals, such as sodium or potassium, the alkaline earth metals, such as calcium and magnesium, and ammonium or substituted ammonium cations including, for example, methyl, dimethyl, trimethyl and quartenary ammonium cations. Substantially any liquid or liquefiable anionic surfactant which has been habitually used in detergent compositions can be employed in the present invention. A comprehensive listing and discussion of anionic surfactants or detergents useful in the present invention can be found in *McCutcheon's Detergents and Emulsifiers* 1993 Annual and in U.S. Pat. No. 3,929,678 which is incorporated herein by reference.

Preferred anionic surfactants useful in the present invention include the water-soluble salts, particularly the alkali metal, ammonium and alkanolammonium salts of organic compounds containing sulfur and having in their molecular structure an alkyl or alkaryl group containing from about 8 to about 22, especially from about 10 to about 20, carbon atoms and a sulfonic acid or sulfuric acid ester group. Examples of this class of surfactants are the sodium and potassium alkyl sulfates and the sodium and potassium alkyl benzene sulfonates in which the alkyl group contains from about 9 to about 15, preferably about 11 to about 13, carbon atoms.

Suitable anionic surfactants are the water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, and alkyl phenol polyethoxy ether sulfates.

Particularly preferred anionic surfactants are the sulfosuccinates and taurates such as the sulfosuccinates derived from mono or diesters of maleic acid and the taurates derived as condensation products of $C_8$–$C_{20}$ fatty acids and taurines.

Preferred anionic surfactants useful in the composition of the present invention are the sulfosuccinates derived from mono or diesters of maleic acid and more preferably derived from diesters of maleic acid. Most preferably the anionic surfactant is dioctyl sodium sulfosuccinate and is preferably present in the range of from about 0.1% to about 20%, more preferably from about 2% to about 10% and most preferably is present in the range of from about 2% to about 5%. Exemplary of the most preferred dioctyl sodium sulfosuccinate of the composition of the present invention is MACKANATE™ DOS-75 sold by McIntyre Group Ltd.

Another anionic surfactant which is preferred in the present invention is the condensation product of a fatty acid and a taurine of the general structure

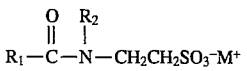

$$R_1-\overset{\overset{\displaystyle O}{\|}}{C}-\overset{\overset{\displaystyle R_2}{|}}{N}-CH_2CH_2SO_3^-M^+$$

where $R_1$ preferably consists of an alkyl group or alkenyl group of 8 to 20 carbon atoms, $R_2$ is a hydrogen, methyl or ethyl group and $M^+$ is any suitable cation. More preferably, the fatty acid is a lauric, palmitic or oleic acid, $R_2$ is methyl and $M^+$ is sodium. Most preferably, the anionic surfactant is the product of the reaction of methyl taurine and oleic acid and is sodium methyl oleoyl taurate, exemplified by TAURANOL ML sold by Finetex Company. Sodium methyl oleoyl taurate is preferably in a range of from about 0.1% to about 20%, more preferably from about 2% to about 10% and most preferably from about 2% to about 5%.

In the most preferred embodiment of the present invention, sodium methyl oleoyl taurate is used in combination with dioctyl sodium sulfosuccinate in the following ranges:

| Ingredient | Preferred Range | More Preferred Range | Most Preferred Range |
|---|---|---|---|
| Sodium Methyl Oleoyl Taurate | 0.05% to 10% | 1% to 5% | 2% to 3% |
| Dioctyl Sodium Sulfosuccinate | 0.05% to 10% | 0.1% to 2% | 0.5% to 1% |

Solvent Mixture

The concentrated liquid glass and window cleaning composition of the present invention also contains a solvent mixture in the range of from about 10% to about 75% by weight. While any type of water soluble solvent may be useful in the present invention, non-limiting examples of suitable water-soluble solvents include the highly water soluble glycol ethers including ethylene glycol monoalkyl ethers, propylene glycol monoalkyl ethers, isopropylene glycol monoalkyl ethers, diethylene glycol monoalkyl ethers, dipropylene glycol monoalkyl ethers, tripropylene glycol monoalkyl ethers and mixtures thereof. More preferably, the solvent mixture of the present invention comprises ethylene glycol monoalkyl ethers, propylene glycol monoalkyl ethers and mixtures thereof. Most preferably, the solvent mixture comprises propylene glycol methyl ether, propylene glycol n-butyl ether, ethylene glycol n-butyl ether and mixtures thereof, Preferably the glycol ether solvent mixture is present in the composition of the present invention in a range of from about 10% to about 75%, and more preferably in a range of from about 30% to about 65%. Most preferably, the glycol ether solvent mixture is present in a range of from about 45% to about 55% with 48% to 52% being optimum.

When the glycol ether solvent mixture comprises a mixture of ethylene glycol monoalkyl ethers and propylene glycol monoalkyl ethers, preferably the solvent mixture comprises from about 2% to about 15% ethylene glycol n-butyl ether, from about 4% to about 30% propylene glycol methyl ether, from about 4% to about 30% propylene glycol n-butyl ether and mixtures thereof. More preferably, the glycol ether solvent mixture comprises from about 6% to about 13% of ethylene glycol n-butyl ether, from about 12% to about 26% of propylene glycol methyl ether, and from about 12% to about 26% of propylene glycol n-butyl ether and mixtures thereof. In the most preferred embodiment, ethylene glycol n-butyl ether is present in a range of from about 9% to about 11%, propylene glycol methyl ether is present in a range of from about 18% to about 22% and propylene glycol n-butyl ether is present in a range of from about 18% to about 22%. When propylene glycol n-butyl ether is in the mixture, propylene glycol methyl ether must be present and the ratio of propylene glycol n-butyl ether to propylene glycol methyl ether is most preferably always 1:1, regardless of the various percentages of each used in the composition of the present invention. Examples of glycol ethers useful in the present invention include ethylene glycol n-butyl ether sold under the trademark DOWANOL® EB by Dow Chemical Company, propylene glycol methyl ether sold under the trademark DOWANOL® PM by Dow Chemical Company and propylene glycol n-butyl ether sold under the trademark DOWANOL® PNB by Dow Chemical Company.

Optional Ingredients

The concentrated all-purpose cleaning composition of the present invention can be supplemented by the usual additives conventionally employed in compositions of this type including the dyes, perfumes, preservatives, suds regulating or suppressing agents and others without detracting from the advantageous properties of the compositions. It is preferred that blue dye is used in the range of from about 0.0001% to about 1%. It is also preferred that methanol used as a denaturing agent be used in the range of about 0.01% to about 2%. Fragrances can also be added in the preferred range of about 0.040% to about 1%. Preferably, the compositions can contain up to about 5% of these optional ingredients.

Water

Water, either treated such as soft or deionized or untreated such as tap water, comprises the balance of the concentrated all-purpose liquid cleaning composition.

Methods of Manufacture

The concentrated all-purpose liquid cleaning composition of the present invention is manufactured through standard manufacturing processes such as mixing or blending the composition and is typically prepared through the sequential addition of ingredients to a mixing vessel with low or high shear mixing provided by a turbine, propeller, impeller or the like with order of addition and temperature suitable to the specific ingredients chosen. In one example, water as necessary is added to the mix vessel, followed by the desired solvents, the desired surfactants and the desired optional ingredients with continuous low speed mixing at ambient temperatures.

Use Procedures

The concentrated all-purpose liquid cleaning composition can be used by itself as a concentrated product and applied directly to the area to be cleaned or first diluted with water to the end user's preferred strength. The composition of the present invention can be diluted up to 1:50 parts cleaning composition to water and still show good cleaning properties. This dilution can take place either in a bucket or other containment device or during the packaging process when being put into a spray-type cleaner. Most preferably, the dilution by the end user is in a ratio of about 1:1 to about 1:20 parts cleaning composition to water and the dilution takes place in a spray cleaner application such as that found in U.S. Pat. No. 5,152,461 and patent application Ser. No. 07/865,001. When using this latter method, the all-purpose liquid cleaning composition is placed in its concentrated form in a bottle and attached to the sprayer device containing another bottle filled with water. The end user simply manipulates the sprayer's concentration ratio, applies the cleaning composition to the surface to be cleaned and thereafter wipes the cleaning composition from said surface.

EXAMPLES

The following examples are provided by way of explanation and description and should not be seen as limiting the scope of the invention.

In the examples that follow, the abbreviations used have the following descriptions:

SMT—Sodium methyl oleoyl taurate marketed by Finetex Company under the trade name TAURANOL ML DSS—Dioctyl sodium sulfosuccinate marketed by McIntyre Group Ltd. under the trade name MACKANATE™ DOS-75

EB—Ethylene glycol n-butyl ether sold under the trademark DOWANOL® EB by Dow Chemical Company PM—Propylene glycol methyl ether sold under the trademark DOWANOL® PM by Dow Chemical Company PNB—Propylene glycol n-butyl ether sold under the trademark DOWANOL® PNB by Dow Chemical Company MET—Methanol (used as a denaturing agent)

Dye—Blue dye used as a colorant

FRG—Fragrance $H_2O$—Water, either treated or untreated

The following liquid Compositions 1 through 6 were prepared by mixing the following ingredients in a standard mixing vessel at room temperature, in the order specified in Methods Of Manufacture.

Examples 1–7

| | (% by weight) | | | | | | |
|---|---|---|---|---|---|---|---|
| Component | 1 | 2 | 3 | 4 | 5 | 6 | 7 (WIN-DEX ®) |
| SMT | 2.50 | 10.0 | — | 3.0 | 3.0 | 1.0 | |
| DSS | 0.80 | — | 10.0 | 1.0 | 1.0 | 0.10 | |
| EB | 9.50 | 9.50 | 9.50 | — | 25.0 | 2.0 | |
| PM | 20.0 | 20.0 | 20.0 | 25.0 | 25.0 | 4.00 | |
| PNB | 20.0 | 20.0 | 20.0 | 25.0 | — | 4.00 | |
| MET | 0.0148 | — | — | — | — | — | |
| Dye | 0.0025 | — | — | 0.001 | — | — | |
| FRG | — | — | — | — | 0.05 | — | |

-continued

| | (% by weight) | | | | | | |
|---|---|---|---|---|---|---|---|
| Component | 1 | 2 | 3 | 4 | 5 | 6 | 7 (WINDEX ®) |
| $H_2O$ | 47.18 | 40.50 | 40.5 | 45.99 | 45.95 | 88.90 | |

Compositions 1 through 6 are considered to be within the scope of the present invention with Composition 1 exemplifying the most preferred embodiment of the compositions of the present invention. Compositions 1 through 5, while containing high amounts of solvent, surprisingly were found to be homogeneous in single-phase liquids with excellent stability over wide temperature ranges. Composition 6 was similarly found to be homogeneous and stable and, although lower in solvent, it shows surprisingly comparable performance. Further, Compositions 1 through 6 are easily dispersible, have good evaporation rates, good cleaning and low levels of streaking.

| | Evaporation Rate | | | | | | |
|---|---|---|---|---|---|---|---|
| Composition | 1 | 2 | 3 | 4 | 5 | 6 | 7 (WINDEX ®) |
| Evaporation Rate | 2.4 | 2.5 | 2.6 | 2.6 | 2.0 | 2.4 | 2.5 |

Compositions 1 through 7 were evaluated for evaporation rate as follows: 2.5 grams of each composition was placed in an aluminum pan and thereafter the pan was placed in a Denver Moisture Balance Model IR100 at 107° C. Weight loss from the sample was monitored for six minutes. The total weight loss of the sample was divided by the weight loss observed for deionized water under the same conditions to yield an evaporation rate. Higher evaporation rates are preferred with rates of about 2.0 or greater being acceptable for this application. The following evaporation rates were observed and compared to an off-the-shelf highly diluted window cleaning product with the results as follows. It was found that compositions 1 through 5, even though containing high amounts of surfactants and solvents, had comparable evaporation rates to Composition 6 which has low amounts of solvents and to the off-the-shelf prediluted product.

| | Stability | | | | | | |
|---|---|---|---|---|---|---|---|
| Composition | 1 | 2 | 3 | 4 | 5 | 6 | 7 (WINDEX ®) |
| Stability | good | good | good | good | good | good | good |

Compositions 1 through 7 were also evaluated for stability by placing approximately 100 grams of the composition into glass containers and thereafter storing the glass containers at room temperature or 120° F. for three days. The samples were then examined for signs of separation, sedimentation or other gross physical instabilities. Three ratings were assigned: good=stable at room temperature, stable at 120° F.; acceptable=stable at room temperature, unstable at 120° F.; unacceptable=unstable at room temperature. All compositions were found to have good stability.

| | Streaking/Spotting | | | | | | |
|---|---|---|---|---|---|---|---|
| Composition | 1 | 2 | 3 | 4 | 5 | 6 | 7 (WINDEX ®) |
| Streaking | 1 | 1 | 1 | 1 | 1 | 1 | 1 |
| Spotting | 0 | 0 | 0 | 0 | 1 | 1 | 3 |

Compositions 1 through 7 were evaluated for streaking and spot removal. Four inch square glass plates were sprayed with very hard water and allowed to stand for three hours at 120° F. to dry, leaving severe water spots. Each plate was then sprayed with a single spray of the composition to be tested and wiped dry. The glass plates were then graded by an expert grader in a light box as specified in ASTM D3556 85 test method for two parameters, spots remaining and streaking, on a scale of 0=no spots or no streaks and 5=completely covered with spots or very streaky versus prepared reference standards. Compositions 1 through 6 showed excellent qualities of no streaking and high spot removal.

| | Dilutions | | | | |
|---|---|---|---|---|---|
| Dilutions | 1:0 | 1:1 | 1:5 | 1:10 | 1:20 |
| Streaking | 1 | 1 | 1 | 1 | 1 |
| Spotting | 0 | 1 | 1 | 1 | 2 |

Composition 1 was diluted in various ratios and thereafter again tested for streaking and spot removal in accordance with the above test methods. Even at a high dilution ratio, Composition 1 continues to show excellent qualities of no streaking and very good spot removal.

It should be understood that a wide range of changes, modifications and equivalents could be made to the embodiments described above. It is therefore intended that the above descriptions illustrate, rather than limit, the invention and that it is the following claims, including all equivalents which define the compositions and methods of use of the compositions of the present invention.

What is claimed is:

1. A concentrated liquid glass and window cleaning composition comprising:

(a) from about 0.1% to about 20% of at least one anionic surfactant selected from the group consisting of sulfosuccinates derived from mono or diesters of maleic acid, taurates derived as condensation products of $C_8$–$C_{20}$ fatty acids and taurines and mixtures thereof; and (b) from about 10% to about 75% of a mixture of at least two glycol ether solvents selected from the group consisting of ethylene glycol monoalkyl ethers and propylene glycol monoalkyl ethers.

2. The concentrated liquid glass and window cleaning composition of claim 1 wherein said glycol ether solvent mixture comprises from about 30% to about 65% by weight of the total composition.

3. The concentrated liquid glass and window cleaning composition of claim 1 wherein said anionic surfactant is sodium methyl oleoyl taurate.

4. The concentrated liquid glass and window cleaning composition of claim 3 wherein said sodium methyl oleoyl taurate is present in the range of from about 2% to about 10%.

5. The concentrated liquid glass and window cleaning composition of claim 1 wherein said anionic surfactant is dioctyl sodium sulfosuccinate in the range of from about 2% to about 10%.

6. The concentrated liquid glass and window cleaning composition of claim 1 wherein said anionic surfactant is a mixture of sodium methyl oleoyl taurate in the range from about 1% to about 5% and dioctyl sodium sulfosuccinate in a range of from about 0.1% to about 2%.

7. The concentrated liquid glass and window cleaning composition of claim 1 wherein said glycol ether solvent mixture comprises from about 4% to about 30% of propylene glycol n-butyl ether, from about 4% to about 30% of propylene glycol methyl ether and from about 2% to about 15% of ethylene glycol n-butyl ether.

8. The concentrated liquid glass and window cleaning composition of claim 1 wherein said glycol ether solvent mixture comprises from about 6% to about 13% ethylene glycol n-butyl ether; from about 12% to about 26% propylene glycol n-butyl ether and from about 12% to about 26% propylene glycol methyl ether.

9. The concentrated glass and window cleaning composition of claim 1 wherein said glycol ether solvent mixture comprises from about 9% to about 11% ethylene glycol n-butyl ether; from about 18% to about 22% propylene glycol n-butyl ether and from about 18% to about 22% propylene glycol methyl ether.

10. The concentrated glass and window cleaning composition of claim 1 wherein said cleaning composition can be diluted by the end user in the range of from about 1:1 to about 1:50 parts cleaning composition to water.

11. A concentrated liquid glass and window cleaning composition comprising:

(a) from about 1% to about 5% of a sodium methyl oleoyl taurate;

(b) from about 0.1% to about 2% of dioctyl sodium sulfosuccinate; and (c) from about 30% to about 65% of a mixture of at least two glycol ether solvents selected from the group consisting of ethylene glycol monoalkyl ethers and propylene glycol monoalkyl ethers.

12. The concentrated liquid glass and window cleaning composition of claim 11 wherein said glycol ether mixture comprises from about 6% to about 13% ethylene glycol n-butyl ether; from about 12% to about 26% propylene glycol n-butyl ether and from about 12% to about 26% propylene glycol methyl ether.

13. A concentrated liquid glass and window cleaning composition comprising:

(a) from about 1% to about 5% of sodium methyl oleoyl taurate;

(b) from about 0.1% to about 2% dioctyl sodium sulfosuccinate; and (c) from about 45% to about 55% of a glycol ether solvent mixture comprising from about 9% to about 11% ethylene glycol n-butyl ether, from about 18% to about 22% propylene glycol n-butyl ether and from about 18% to about 22% propylene glycol methyl ether.

14. A method for cleaning glass and window surfaces with a concentrated liquid cleaning composition comprising the steps of:

(1) diluting with water in a ratio acceptable to the end user a concentrated liquid glass and window cleaning composition comprising:

(a) from about 1% to about 5% of sodium methyl oleoyl taurate;

(b) from about 0.1% to about 2% of dioctyl sodium sulfosuccinate; and (c) from about 30% to about 65% of a mixture of at least two glycol ether solvents selected from the group consisting of ethylene glycol monoalkyl ethers and propylene glycol monoalkyl ethers;

(2) applying said cleaning composition to the surface to be cleaned; and (3) wiping from said surface said cleaning composition.

* * * * *